United States Patent [19]

Wauters

[11] Patent Number: 4,860,947

[45] Date of Patent: Aug. 29, 1989

[54] BOTTLE BOXES

[75] Inventor: Jacques G. Wauters, Montreuil, France

[73] Assignee: Ch. Wauters & Fils, Palaiseau Cedex, France

[21] Appl. No.: 254,239

[22] Filed: Oct. 6, 1988

[30] Foreign Application Priority Data

Oct. 9, 1987 [FR] France ..... 87 13971

[51] Int. Cl.[4] ..... B65D 5/38; B65D 5/44

[52] U.S. Cl. ..... 229/103; 206/44 K; 206/45.14

[58] Field of Search ..... 229/103, 52 B, 138; 206/44 K, 45.14, 141, 199, 428, 427

[56] References Cited

U.S. PATENT DOCUMENTS

| | | | |
|---|---|---|---|
| 2,458,766 | 1/1949 | Chemlinski | 206/45.14 |
| 3,451,612 | 6/1969 | Sinoto | 229/103 |
| 4,396,115 | 8/1983 | Watson | 206/45.14 X |

FOREIGN PATENT DOCUMENTS

| | | | |
|---|---|---|---|
| 1413174 | 8/1965 | France . | |
| 1537787 | 7/1968 | France . | |
| 2220431 | 11/1974 | France | 206/45.14 |
| 464696 | 7/1951 | Italy | 206/45.14 |
| 911277 | 11/1962 | United Kingdom | 206/428 |

*Primary Examiner*—Stephen Marcus
*Assistant Examiner*—Jes F. Pascua
*Attorney, Agent, or Firm*—Sandler & Greenblum

[57] ABSTRACT

A packaging box that may be manipulated to form a basket for serving a bottle of wine which includes a first box portion that is engagable in a second tubular box portion. The first box portion is oblong and prismatic and includes flaps along upper edges of major surfaces that may be manipulated to form handles, in addition to flaps along an upper edge of a small surface that may be manipulated to receive and support the neck of a bottle, as well as a foldable flap portion along an upper edge of a second small surface that may be manipulated to support the bottom of a bottle.

20 Claims, 2 Drawing Sheets

BOTTLE BOXES

BACKGROUND OF THE INVENTION

1. Field of the Invention

The present invention relates to improved packaging, containers and boxes, for objects, such as bottles or similarly shaped articles, and is particularly directed to a novel and unique container for a bottle which is adapted to function as a package for the bottle during shipping, storage and handling, in addition to be adapted to be converted into a box or other container adapted for holding the bottle for display or serving purposes.

2. Description of Background and Material Information

Conventional boxes which are used to package bottles include two interfitting portions. One portion is in the shape of an oblong box having an open side into which a bottle to be packaged is placed. The other portion is in the form of a case into which the first portion may be interfitted so as to seal the open side of the first portion.

Prior to the present invention, packaging boxes for bottles were only designed to contain bottles for shipping, storage and handling. In this regard, the only consideration given to designing such boxes was the ease with which the bottles could be packaged in these boxes. These conventional boxes were discarded after the bottles were unpackaged and removed. No further use was made of the empty boxes.

In conventional use, upon opening a bottle packaging box enclosing a bottle, e.g., containing a quality of wine, the bottle is removed from the box and the box is then discarded. The unpackaged bottle is then placed in a bottle basket in which the bottle is held in a semi-flat or inclined position. The wine is thus served from the bottle positioned in the bottle basket by manipulating the bottle basket.

SUMMARY OF THE INVENTION

It is an object of the present invention to provide a bottle packaging box which can be easily transformed from a shipping container, which encloses and secures a bottle for shipping, storage and handling, into a bottle basket, which can be utilized for supporting the bottle in an inclined position and for serving wine contained in the bottle.

The bottle packaging box according to the present invention includes various foldable flaps and webs that enable the box to be manipulated into either a bottle packaging container for enclosing and securing a bottle for shipping purposes or into a form similar to that of bottle basket in which a bottle is supported in an inclined position and in which wine may be served from the bottle.

BRIEF DESCRIPTION OF THE DRAWINGS

The present invention will now be described with reference to the annexed drawings, which are given by way of non-limiting examples only, in which.

DESCRIPTION OF PREFERRED EMBODIMENTS

Figure 1:
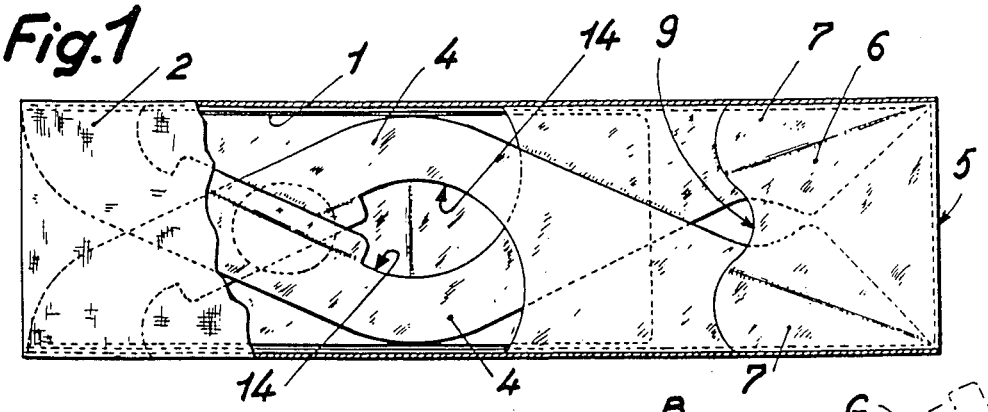
FIG. 1 is a top view of the bottle packaging box of the present invention, having the exterior case being partially broken away.

Referring to the drawings and according to one exemplary embodiment, it is seen that the box is composed of two portions, the first box portion 1, which is oblong and prismatic, and a second tubular case portion 2, into which the box portion is engagable.

According to the invention, box portion 1 includes, along the length of an upper edge of each of its major side surfaces 3, a flap 4 and along the length of an upper edge of one of its smaller side surfaces 5, a flap 6.

Flap 6 is connected to flaps 4 by a web having two portions, 7 and 8.

When box portion 1 is engaged in case 2, the flap 6 is bent back against flaps 4, as illustrated in FIG. 1. The lifting of flap 6 causes flaps 4 to be lifted.

Flap 6, as illustrated in the drawings, is formed with a cut-out portion 9 located at an upper edge thereof for receiving the neck G of a bottle B.

Figure 2:
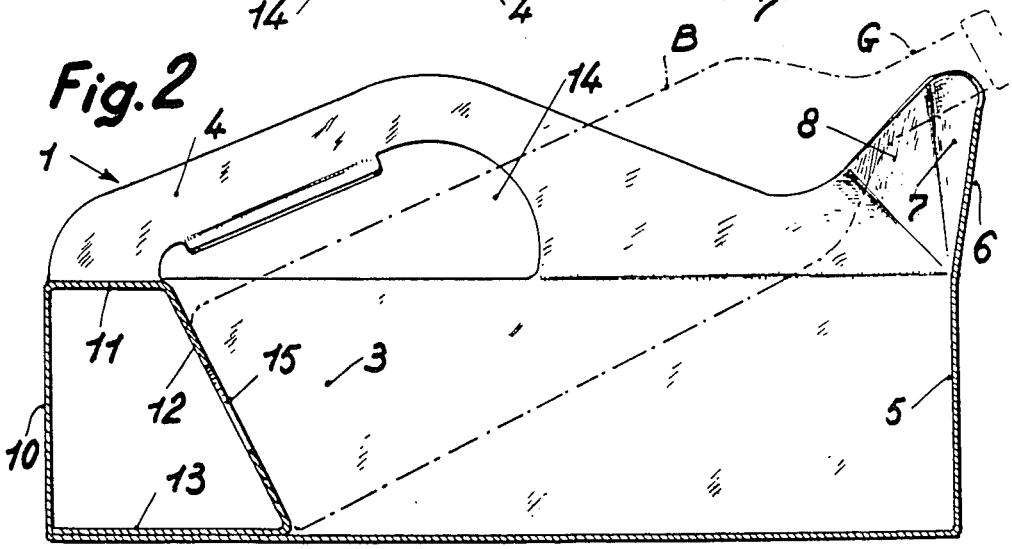
FIG. 2 is an elevational cross-section view illustrating the use of a bottle packaging box according to the present invention as a bottle basket.
Figure 3:
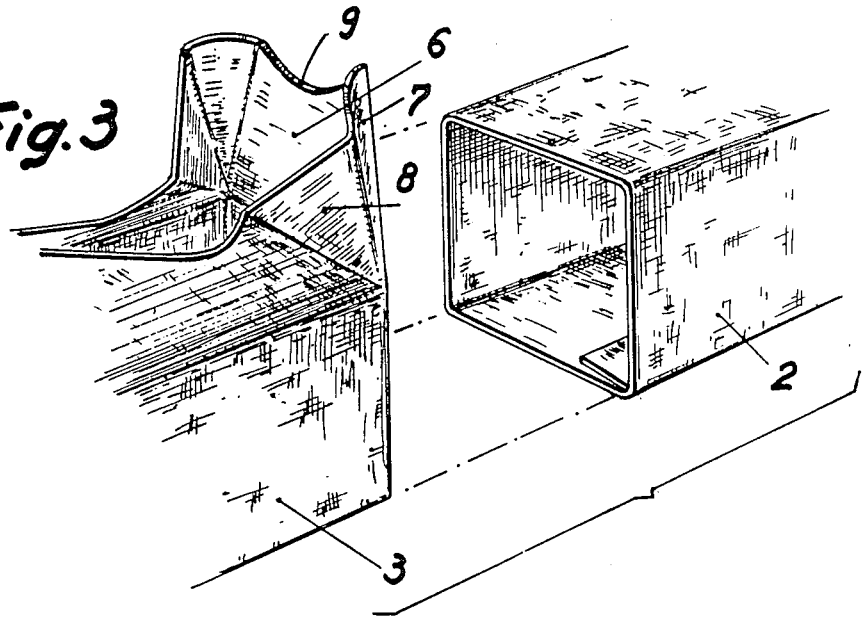
FIG. 3 is a partial perspective view illustrating a detailed embodiment of the box of a bottle packaging box of the present invention.
Figure 4:
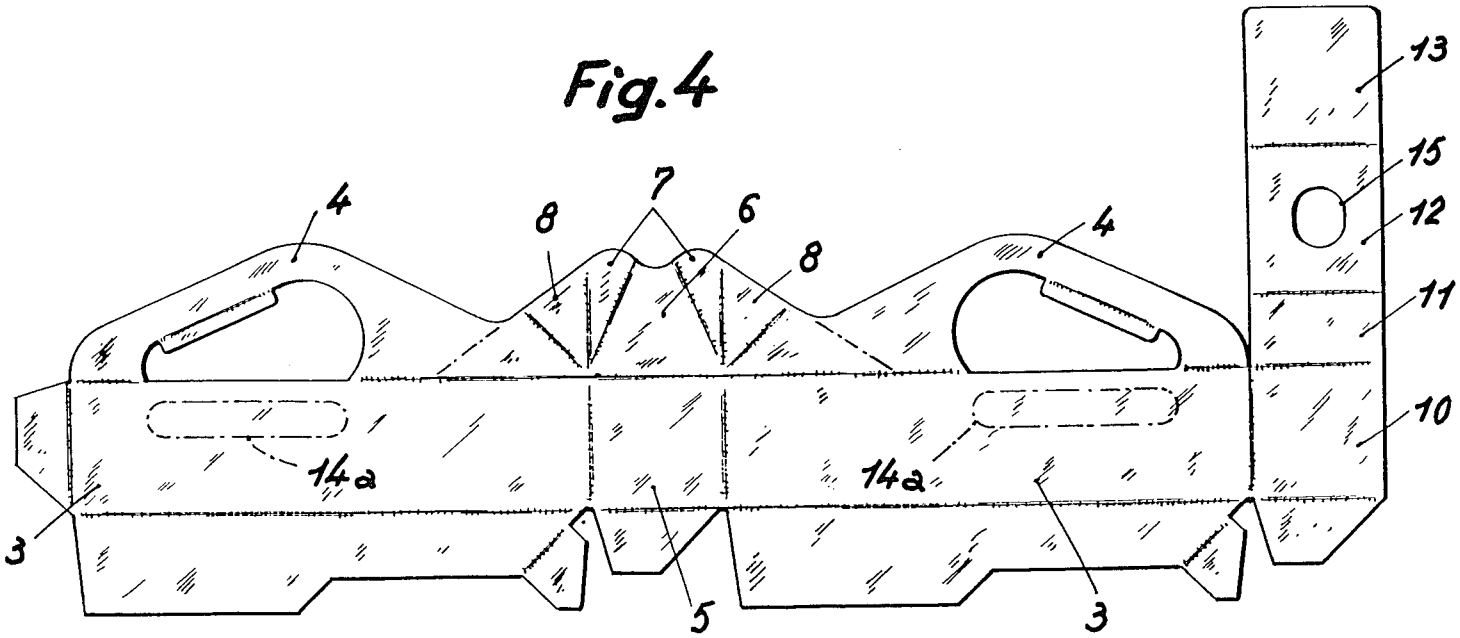
FIG. 4 is a planar view showing a flat blank from which it possible to form the box of FIGS. 1–3.

As illustrated in FIG. 4, the upper edge of the minor side surface 10 of the box includes three flap portions which form a flap that extends from an upper edge of minor side surface 10. These three flap portions include a central portion 12, an end portion 13 and a portion 11 that connects the central portion to minor side surface 10. The length of end portion 13 is greater than that of the portion 11. These portions may be folded as is shown in FIG. 2 to form a support for the bottom of the bottle.

Each of flaps 4 has an opening 14 which enable flaps 4 to be used as handles, making it possible to manipulate the box and to pour wine contained a bottle B, positioned in the manipulated box.

In another embodiment, flaps 4 can be eliminated. In this case, portion 8 of the web is connected directly along the length of the upper edge of major side surfaces 3 and openings **14*a*, which serve as handles, are provided in the surfaces. Modifications according to this embodiment are shown in dashed lines in FIG. 4**.

According to another embodiment, central portion 12 of the foldable flap may include an opening 15, as illustrated in FIG. 4, for engaging the neck G of a bottle to secure its position in the box during transport.

As discussed in detail above, the box of the present invention includes a first, prismatic box portion open along major surface. The first box portion is engagable in a second tubular case portion so that the two portions, when engaged, totally enclose a bottle to be packaged.

The first box portion includes flaps formed along upper edges of major side surfaces thereof which form a handle and a flap formed along an upper edge of a minor side surface thereof which connects to the flaps formed along the upper edges of the major side surfaces by means of a web in two foldably connected portions.

The first box portion further includes a flap which comprises three portions, extending from an upper edge of an opposing minor side surface thereof which can be folded in a manner such that a portion of the flap is supported against an internal portion of the opposing minor side surface.

In a more particular embodiment the box of the present invention includes a first box portion and a second case portion, with said two portions shaped and dimensioned so that the first box portion is engagable in the second case portion. The first box portion is basically a rectangular shaped container having two opposed major side surfaces, two opposed smaller side surfaces and a foldable extension that extends continuously along an upper edge of at least one of the smaller side surfaces and an upper edge portion of both of the major side surfaces. The foldable extension is foldable in a first position in which the first box portion may be engaged in the second case portion, and a second position to form a bottle basket to receive and support a bottle in an inclined position.

The foldable extension may extend partially along the upper surfaces of both the major side surfaces or may extend along substantially the entire upper surface of both the major side surfaces.

The first box portion further includes a pair of cutout handle sections in the major side surfaces in the case where the foldable extension extend only partially along the upper surface of the major side surfaces. In an embodiment wherein the foldable extension extends along substantially the entire upper surface of both of the major side surfaces, the handle cut-outs are formed in the foldable extension.

In order to properly support a bottle when manipulated into a bottle basket form, the first box portion includes a cut-out portion located in the center of the foldable extension for receiving and supporting a neck of a bottle.

In order to allow for the foldable extension to be properly foldable into a bottle packaging position and a bottle basket position the foldable extension comprises at least one flap and at least two pairs of web portions, and preferably three flap portions and two pairs of web portions.

In order to support the bottom of a bottle when manipulated into a bottle basket form the first box portion includes a foldable flap portion on an upper edge of a smaller side surface that is opposed from the least one smaller side surface that includes the foldable extension. This foldable flap comprises at least three flap portions, including a central flap portion having a hole therein for receiving a neck of a bottle for securing the bottle during transportation.

In each of the above described embodiments the first box portion is designed to formed from a flat, cut-out blank that can be folded to form the both the first bottle packaging position and the second bottle basket position.

More particularly, the flat cut-out blank for forming a box for packaging objects according to the present invention includes a generally elongated main portion provided with longitudinal and transverse score lines. The longitudinal and transverse score lines divide the generally elongated main portion into two major side surfaces, two minor end surfaces, a top flap section, at least three bottom flaps and a top flap section.

The flat cut-out blank further includes an elongated end portion that extends perpendicularly from one of the two minor end surfaces. The elongated end portion is provided with transverse score lines that divide said elongated end portion into at least three foldable subsections.

In forming the box, the generally elongated main portion is folded along the longitudinal and transverse score lines to form a rectangular container in which the two major side surfaces are opposed from each other, the two minor end surfaces are opposed from each other and the three bottom flanges mate together to form a rectangular container having an open top and a closed bottom.

The top flap section is adapted to be folded to at least partially cover the open top of the rectangular container and the elongated end portion is adapted to be folded along its transverse score lines so as to form an inclined base within the rectangular container.

In order to form a support to receive the neck of a bottle, the top flap section includes at least three angled score lines.

A pair of cut-out handle portions for manipulating the rectangular container are formed either in the top flap section or in the two main side surfaces.

The present invention is not to be limited only to the exemplary embodiments described and shown for illustration purposes, but extends to all variations of shapes and dimensions within the scope of the present invention.

Although the invention has been described with reference to particular means, materials and embodiments, it is to be understood that the invention is not limited to the particulars disclosed but extends to all equivalents within the scope of the claims.

What is claimed is:

1. A box for a bottle comprising:

(a) a first box portion open along one major surface comprising:

(i) at least one (1) flaps formed along upper edges of two major side surfaces of said first box portion adapted to form a handle;

(ii) at least another flap formed along an upper edge of a minor side surface of said first box portion adapted to be connected to each of said flaps formed along upper edges of said major side surfaces; and (iii) a web having two foldably connection portions connecting said flaps to said at least another flap;

(b) a second tubular case portion for engaging said first box portion.

2. The box for a bottle according to claim 1 wherein an upper edge of another minor side surface has a flap comprising an end portion adapted to be folded in a manner such that an edge of the end portion is supported against an internal portion of said another minor side surface.

3. The box for a bottle according to claim 1 wherein said box is formed from a flat cut-out blank.

4. The box for a bottle according to claim 2 wherein said box is formed from a flat cut-out blank.

5. A box for packaging objects comprising (a) a first box portion comprising a rectangular shaped container having (i) two opposed major side surfaces, (ii) two opposed smaller side surfaces; and (iii) a foldable extension that extends continuously along an upper edge of at least one of said smaller side surfaces and an upper edge portion of both of said major side surfaces; and (b) a second case portion; said first box portion being engagable in the second case portion, whereby said foldable extension is foldable in a first position in which said first box portion may be engaged in said second case portion, and a second position to receive and support an object in an inclined position.

6. A box according to claim 5 wherein said foldable extension extends along substantially the entire upper edge portion of each of said opposed major side surfaces.

7. A box according to claim 5 further including a pair of cut-out handle sections in said opposed major side surfaces.

8. A box according to claim 5 further including a pair of cut-out handle sections in said foldable extension.

9. A box according to claim 5 wherein a central area of said foldable extension includes a cut-out portion for receiving and supporting said object.

10. A box according to claim 5 wherein said foldable extension comprises at least one flap portion and at least two pairs of web portions.

11. A box according to claim 10 wherein said at least one flap portion comprises three flap portions.

12. A box according to claim 5 further including a foldable flap section on an upper edge of another smaller side surface that is opposed from said at least one of side smaller side surfaces.

13. A box according to claim 12 wherein said foldable flap section comprises at least three, flap subsections.

14. A box according to claim 13 wherein a central flap subsection of said foldable flap section includes means for receiving and securing an object during transportation.

15. A box according to claim 5 wherein said box is formed from a flat, cut-out blank.

16. A box according to claim 12 wherein said box is formed from a flat, cut-out blank.

17. An article including a box containing a bottle said article comprising:

(a) a box comprising:

(i) a first box portion comprising: a rectangular shaped container having two opposed major side surfaces, two opposed smaller side surfaces and a foldable extension that extends continuously along an upper edge portion of both of said major side surfaces, (ii) a second case portion; whereby said foldable extension is foldable in a first position in which said first box portion secures said bottle and may be engaged in said second case portion, and a second position to receive and support said bottle in an inclined position, a portion of said bottle being supported by said foldable extension; and (b) a bottle contained in said box.

18. A flat cut-out blank for forming a box for packaging objects comprising:

a generally elongated main portion, said elongated main portion being provided with longitudinal and transverse score lines whereby said longitudinal and transverse score lines divide said generally elongated main portion into two main side surfaces, two minor end surfaces, a top flap section, at least three bottom flaps and a top flap section; and an elongated end portion that extends perpendicularly from one of said two minor end surfaces, said elongated end portion being provided with transverse score lines whereby said transverse score lines divide said elongated end portion into at least three subsections, wherein said generally elongated main portion is adapted to be folded along said longitudinal and transverse score lines to form a rectangular container in which said two main side surfaces are opposed from each other, said two minor end surfaces are opposed from each other and said at least three bottom flaps mate together to form a rectangular container having an open top, said top flap section is adapted to be folded to at least partially cover the open top of the rectangular container and said elongated end portion is adapted to be folded along its transverse score lines so as to form an inclined base within the rectangular container.

19. A flat cut-out blank for forming a box for packaging objects according to claim 18 wherein said top flap section comprises at least three angled score lines and a pair of cut-out handle portions.

20. A flat cut-out blank for forming a box for packaging objects according to claim 18 wherein said top flap section comprises at least three angled score lines and said generally elongated main portion includes a pair of cut-out handle portions.

* * * * *